US010400380B2

(12) United States Patent
Lee

(10) Patent No.: US 10,400,380 B2
(45) Date of Patent: Sep. 3, 2019

(54) LIQUID ADDITIVE SUPPLY DEVICE FOR WASHING MACHINE

(71) Applicant: Dongbu Daewoo Electronics Corporation, Seoul (KR)

(72) Inventor: Jong Jin Lee, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 105 days.

(21) Appl. No.: 15/265,694

(22) Filed: Sep. 14, 2016

(65) Prior Publication Data

US 2017/0233931 A1 Aug. 17, 2017

(30) Foreign Application Priority Data

Feb. 16, 2016 (KR) ..... 10-2016-0017547

(51) Int. Cl.

| | |
|---|---|
| ***D06F 39/02*** | (2006.01) |
| ***D06F 33/02*** | (2006.01) |
| ***D06F 37/42*** | (2006.01) |
| ***D06F 39/10*** | (2006.01) |
| *D06F 39/12* | (2006.01) |

(52) U.S. Cl.

CPC ..... *D06F 39/022* (2013.01); *D06F 37/42* (2013.01); *D06F 39/10* (2013.01); *D06F 33/02* (2013.01); *D06F 39/12* (2013.01); *D06F 2202/02* (2013.01); *D06F 2202/12* (2013.01); *D06F 2204/10* (2013.01)

(58) Field of Classification Search

CPC ..... D06F 39/02; D06F 39/022; D06F 39/10; D06F 39/12; D06F 33/02; D06F 37/42; D06F 2202/02; D06F 2202/12; D06F 2204/10

See application file for complete search history.

(56) References Cited

U.S. PATENT DOCUMENTS

| | | | | |
|---|---|---|---|---|
| 2003/0145633 | A1* | 8/2003 | Merkle | D06F 39/02 68/17 R |
| 2010/0000022 | A1* | 1/2010 | Hendrickson | D06F 39/02 8/137 |
| 2010/0000578 | A1* | 1/2010 | Hendrickson | D06F 39/022 134/34 |
| 2011/0153871 | A1* | 6/2011 | Ferragut, II | F24C 7/082 710/8 |
| 2012/0037659 | A1* | 2/2012 | Hagleitner | A47K 5/1207 222/39 |

(Continued)

FOREIGN PATENT DOCUMENTS

| | | | |
|---|---|---|---|
| CN | 1465800 | A | 1/2004 |
| CN | 102409515 | A | 4/2012 |

(Continued)

*Primary Examiner* — Joseph L. Perrin

(57) ABSTRACT

A liquid additive supplying device in a washing machine. The liquid additive supplying device is removably accommodated in an accommodation part of the detergent dispenser system of the washing machine. A magnetic body and a magnetic sensor in the liquid additive supplying device interplay to detect the presence of the liquid additive supplying device within the accommodation part. The liquid additive supplying device includes another pair of magnetic body and magnetic sensor for detecting the amount of liquid additive contained therein.

20 Claims, 5 Drawing Sheets

(56) References Cited

U.S. PATENT DOCUMENTS

2012/0174632 A1* 7/2012 Sung ..... D06F 39/022
68/17 R

FOREIGN PATENT DOCUMENTS

| | | | | | |
|---|---|---|---|---|---|
| CN | 203595299 | U | | 5/2014 | |
| CN | 104178975 | A | | 12/2014 | |
| CN | 204211975 | U | | 3/2015 | |
| CN | 204343056 | U | | 5/2015 | |
| EP | 3018248 | A1 | | 5/2016 | |
| KR | 1020080092199 | | * | 10/2008 | ..... D06F 39/02 |
| WO | 2015002413 | A1 | | 1/2015 | |

* cited by examiner

LIQUID ADDITIVE SUPPLY DEVICE FOR WASHING MACHINE

CROSS-REFERENCE TO RELATED APPLICATIONS

This application is based on and claims priority from Korean Patent Application No. 10-2016-0017547, filed on Feb. 16, 2016, the disclosure of which is incorporated herein in its entirety by reference.

TECHNICAL FIELD

The present disclosure relates to washing machines, and more particularly, to liquid additive supply devices for washing machines.

BACKGROUND

In general, detergent is added to washing machines and dispensed for washing laundry during washing cycles. A washing machine typically uses a detergent dispenser to supply and dispense detergent to the washing machine. The detergent dispenser has a drawer-type detergent supply device. A user can pull out the detergent supply device partially to add detergent.

As extraneous material such as dust or the like is likely introduced into the detergent supply device together with the detergent, detergent residue can build up in the detergent supply device. Especially after a long period of non-use, the residue tends to become stuck in the detergent supply device. In a conventional detergent dispenser, the detergent supply device is not designed to be detached from the detergent dispenser by a user, making it difficult to clean the detergent residue at the bottom of the detergent supply device.

To solve this issue, a detergent supply device removably mounted to a detergent dispenser has been developed. However, because such detergent supply device is installed in an internal space of a washing machine, it is difficult for a user to remove the detergent supply device from, or place it back into, the detergent dispenser.

PRIOR ART DOCUMENTS

Patent Documents

Patent Document 1: Korean Patent Application Publication No. 10-2008-0092199 (published on Oct. 15, 2008)

SUMMARY

Embodiments of the present disclosure provide a liquid additive supply device that can be easily removed from and attached back to the detergent dispenser on a washing machine by a user. Thereby, a user can advantageously clean the liquid additive supply device conveniently. According to an embodiment of the present invention, a liquid additive supply device for a washing machine, the liquid additive supply device includes a main body coupled to a detergent dispenser of the washing machine and configured to contain a liquid additive; an accommodation part provided in the detergent dispenser; a magnetic body coupled to the main body; and a mounting/demounting detection sensor coupled to the accommodation part and configured to detect a presence proximity of the magnetic body with respect to the mounting/demounting detection sensor and to generate a sensing signal accordingly.

Further, the magnetic body is disposed on a lower surface of the main body.

Further, the mounting/demounting detection sensor is disposed on an outer surface of the main body.

Further, a liquid additive supply device further includes an accommodation part in the detergent dispenser. The main body is removably accommodated within the accommodation part.

Further, a liquid additive supply device further includes a control unit configured to receive the sensing signal from the mounting/demounting detection sensor and to determine a presence of the main body within the accommodation part.

Further, a liquid additive supply device further includes a notification device configured to receive a control signal generated by the control unit and to generated an indication of the presence of the main body within the accommodation part.

Further, the main body comprises: a first storage part configured to store a first liquid additive; and a second storage part configured to store a second liquid additive.

The main body further comprises a nozzle configured to receive liquid additives supplied from the first storage part and the second storage part and to guide the first and the second liquid additives upward from a lower portion of the main body to an upper portion thereof.

The magnetic body is disposed in a front region of the main body where the first and the second liquid additive are supplied.

A bottom surface of the main body is downwardly inclined from the front region of the main body toward a rear region of the main body where the nozzle is located.

Further, a liquid additive supply device further includes a buoyancy body rotatably and hingedly coupled to a lower portion of the main body and comprising a liquid additive residual amount detection magnetic body; and a residual amount detection sensor coupled to the main body and configured to sense proximity of the buoyancy body.

Further, the residual amount detection sensor is disposed on an outer surface of the main body in a position facing the buoyancy body.

Further, a liquid additive supply device further includes a cover part operable to cover a top opening of the main body.

Also in one embodiment, a washing machine includes a detergent dispenser comprising an accommodation part and configured to dispense a liquid additive for washing laundry; a liquid additive supply device coupled to the detergent dispenser. The liquid additive supply device comprises a main body removably coupled to the detergent dispense and configured to contain a liquid additive; a magnetic body coupled to the main body; and a mounting/demounting detection sensor coupled to the accommodation part and configured to detect a presence of the main body within the accommodation part by sensing a magnetic field of the magnetic body.

Further, the liquid additive supply device further comprises a filter configured to partition the main body into a first main body portion and a second main body portion.

Further, the liquid additive supply device further comprises a nozzle disposed in a bottom portion of the second main body portion and configured to receive the liquid additive from the main body and to transport the liquid additive upward from a lower portion of the main body to a an upper portion thereof.

Further, the magnetic body is disposed on a lower surface of the first main body portion. The mounting/demounting detection sensor is disposed on an outer surface of the main body in a position facing the magnetic body.

Further, a bottom surface of the main body is downwardly inclined from a front region of the main body toward a rear region of the main body where the nozzle is located.

Further, the liquid additive supply device further comprises: a buoyancy body rotatably coupled to a lower portion of the main body and comprising a first magnetic body; and a residual amount detection sensor coupled to the main body and configured to: sense proximity of the buoyancy body by detecting a magnetic field of the first magnetic body; and generate a signal indicative of an amount of the liquid additive contained in the main body.

Further, the residual amount detection sensor is disposed on an outer surface of the main body in a position facing the buoyancy body.

DETAILED DESCRIPTION

Figure 1:
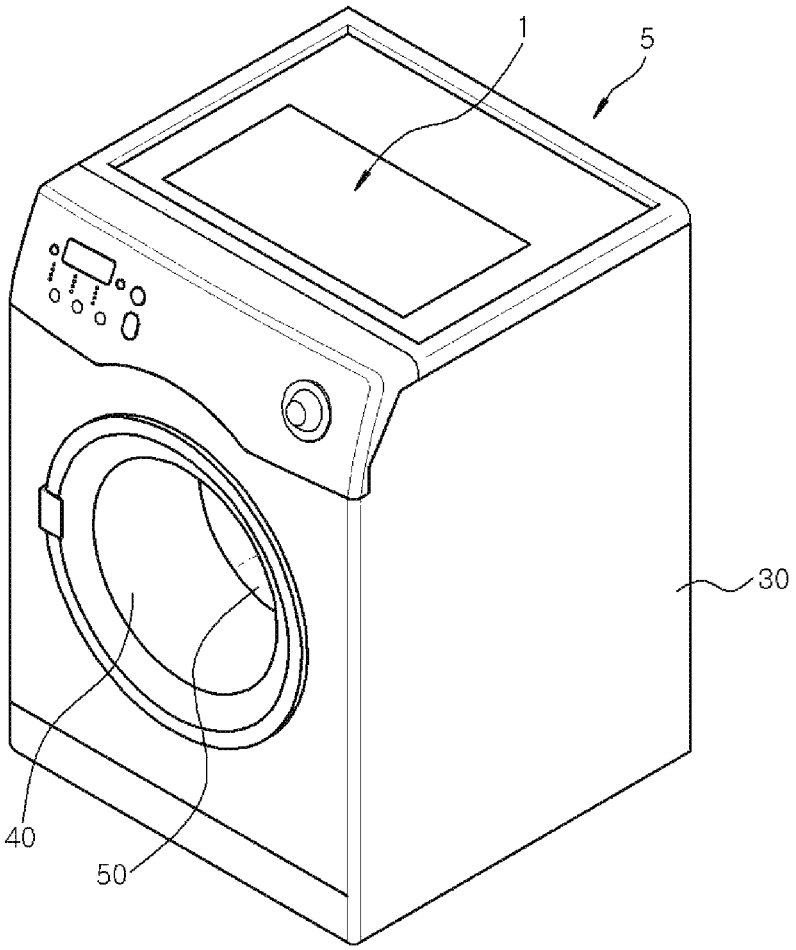
FIG. 1 illustrates a perspective view of an exemplary washing machine according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplificative and not limitative. The same reference numerals designate the same structures, elements, or parts illustrated in two or more drawings in order to exhibit similar characteristics.

The exemplary embodiments of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Figure 2:
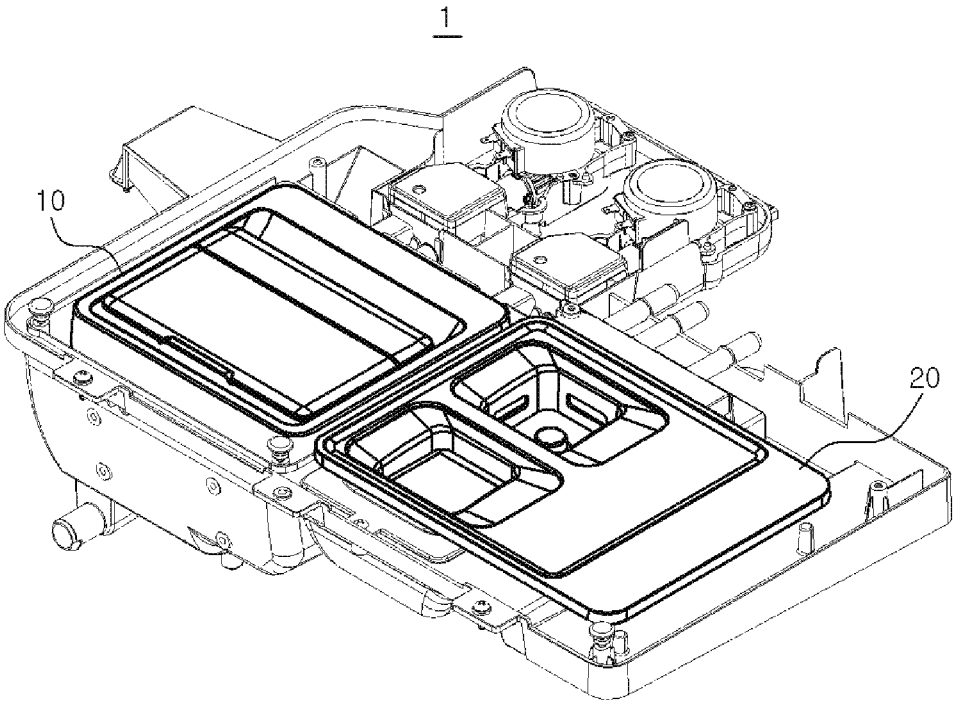
FIG. 2 illustrates an assembled perspective view of an exemplary liquid additive supply device for a washing machine according to one embodiment of the present disclosure.
Figure 3:
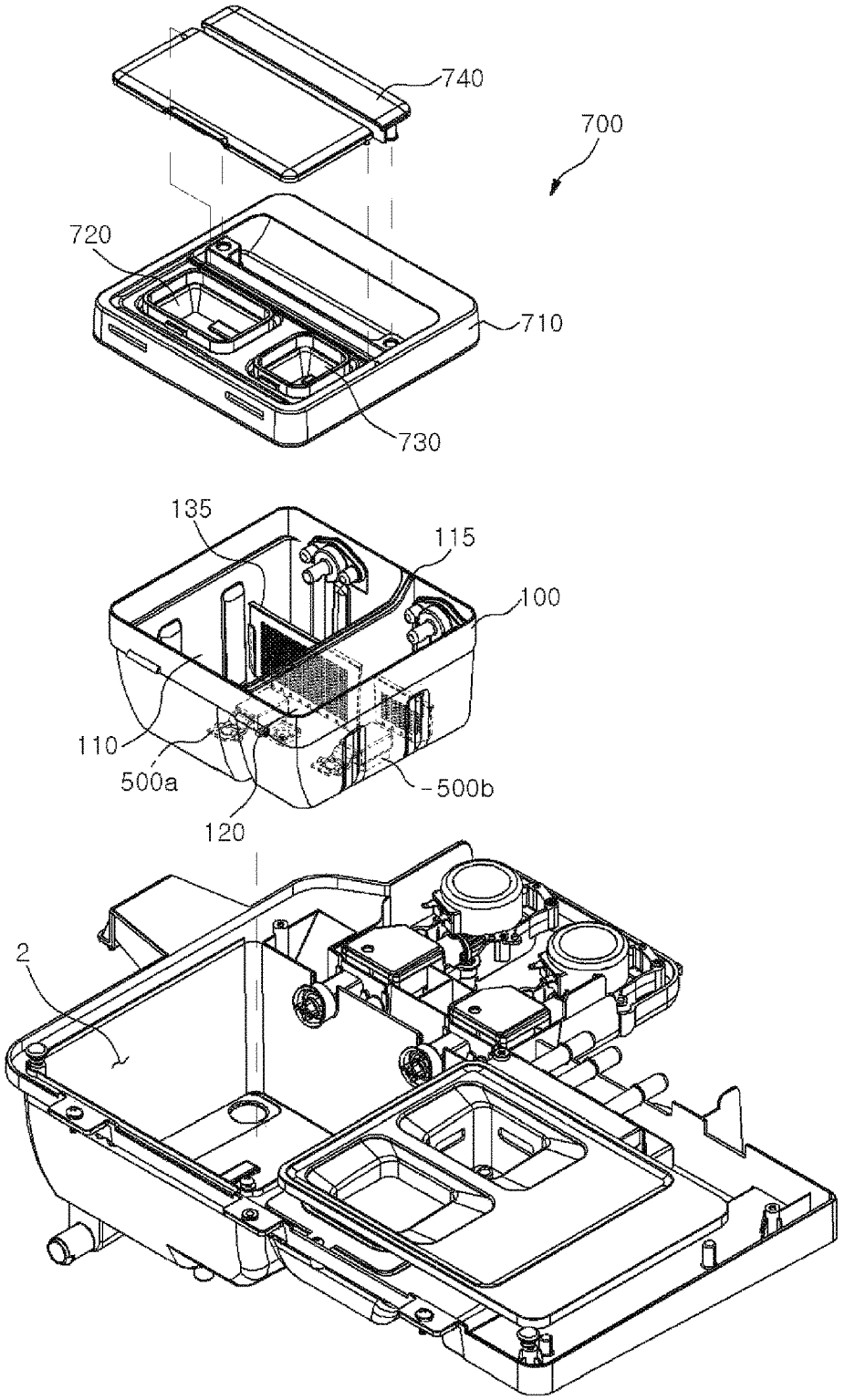
FIG. 3 illustrates an exploded perspective view of the exemplary liquid additive supply device for a washing machine according to one embodiment of the present disclosure.
Figure 4:
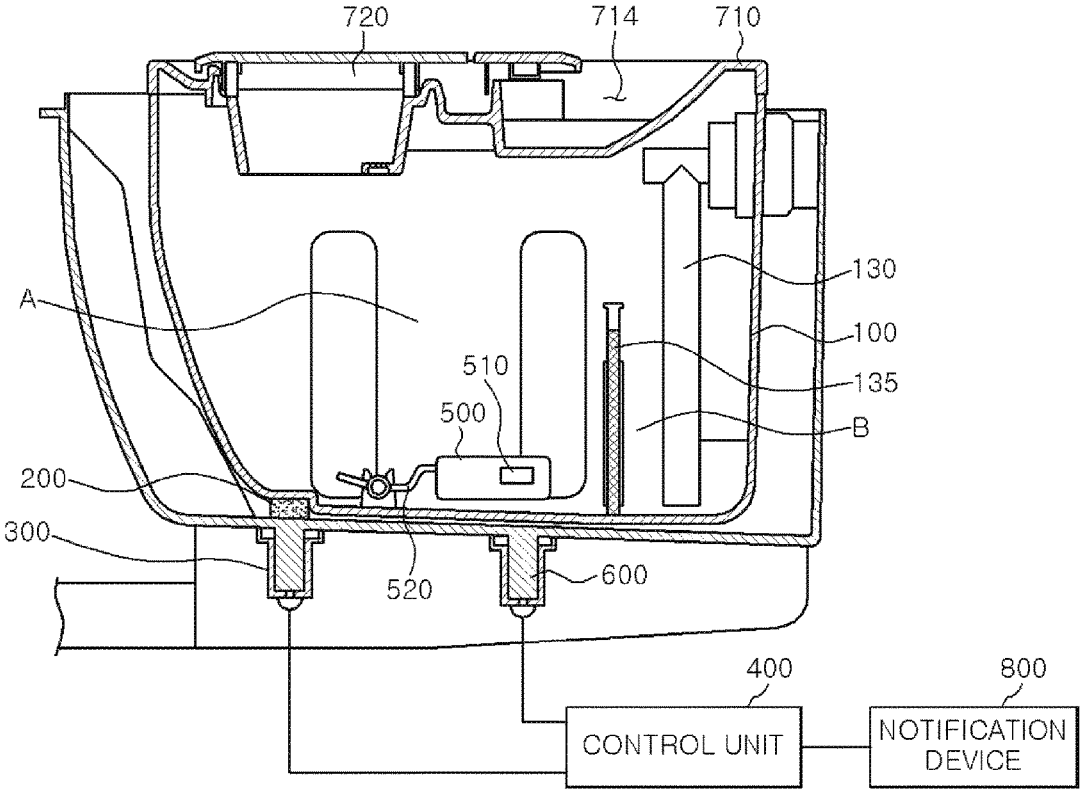
FIG. 4 illustrates a view of a mounting/demounting detection magnetic body and a mounting/demounting detection sensor of the liquid additive supply device for a washing machine according to one embodiment of the present disclosure.

FIG. 1 illustrates a perspective view of an exemplary washing machine according to one embodiment of the present disclosure. FIG. 2 illustrates an assembled perspective view of an exemplary liquid additive supply device for a washing machine according to one embodiment of the present disclosure. FIG. 3 illustrates an exploded perspective view of the exemplary liquid additive supply device according to one embodiment of the present disclosure. FIG. 4 illustrates an exemplary mounting/demounting detection magnetic body and an exemplary mounting/demounting detection sensor of the liquid additive supply device according to one embodiment of the present disclosure.

Referring first to FIG. 1, the washing machine 5 includes a cabinet 30, a tub 40, a drum 50 and a detergent dispenser 1. The washing machine 5 may be a drum type washing machine having a rotatable the drum 50. However, the washing machine 5 is not limited to any specific type.

The cabinet 30 includes an exterior housing of the washing machine 5. The tub 40, the drum 50 and the like may be installed within the cabinet 30. The detergent dispenser 1 may be assembled at the top of the cabinet 30.

In addition to the tub 40, the drum 50 and the detergent dispenser 1, various other components of different functions may be enclosed in the cabinet 30. For example, in the cabinet 30, there may be installed a detergent supply pipe (not shown) configured to couple the detergent dispenser 1 to the tub 40, so that the detergent contained in the detergent dispenser 1 can be carried and dispensed to the tub 40. An electric motor may be configured to provide power to the drum 50. A water supply device (not shown) may be used to supply washing water into the tub 40. A drying device (not shown) may be used to dry the objects (e.g., laundry) inside the tub 40. A drain device (not shown) may be configured to drain the washing water outside the cabinet 30.

The tub 40 has a cylindrical structure used to accommodate washing water. It is horizontally positioned within the cabinet 30. The tub 40 may receive detergent from the detergent dispenser 1, may receive washing water from the water supply device. Washing water can be drained from the tub 40 to the outside of the cabinet 30 through the drain device.

The drum 50 may be rotatably installed inside the tub 40 and coupled to a motor. The drum 50 can contain laundry or other washing objects during operation. The laundry is stirred with the rotation of the drum 50 and washed with the washing water and detergent supplied into the tub 40.

The detergent dispenser 1 may include a liquid additive supply device 10 removably coupled to an accommodation part 2 inside the detergent dispenser 1 and a preliminary additive supply device 20 integrally formed with the detergent dispenser 1.

Referring to FIGS. 2 to 4, the liquid additive supply device 10 according to one embodiment of the present disclosure may include: an accommodation part 2 formed in the detergent dispenser 1; a main body 100 removably accommodated within the accommodation part 2 and configured to store liquid additive. A mounting/demounting detection magnetic body 200 is installed at the bottom of the main body 100. A mounting/demounting detection sensor 300 is installed on an outer surface of the main body 100, facing the mounting/demounting detection magnetic body 200. The detection sensor 300 is configured to sense the presence or approaching of the mounting/demounting detection magnetic body 200 to generate a sensing signal. A control unit 400 can receive the sensing signal from the mounting/demounting detection sensor 300 and accordingly determine the presence or absence of the main body 100 in the accommodation part 2.

A buoyancy body 500 is rotatably and hingedly coupled to the lower portion of the main body 100 and includes a residual amount detection magnetic body 510 for sensing the residual amount of liquid additives, such as liquid detergent or fabric softener. A residual amount detection sensor 600 is installed on the outer surface of the main body 100 in a position facing the buoyancy body 500. A cover part 700 is configured to selectively cover an upper portion of the main body 100. A notification device 800 is configured to receive a control signal from the control unit 400 and accordingly notify a user of the presence or absence of the main body 100 in the accommodation part 2.

The liquid additive supply device 10 can contain a liquid additive (e.g., liquid detergent or fabric softener) to be supplied into the tub 40 during a washing process. Furthermore, the preliminary additive supply device 20 can contain another additive, for example preliminary additive (e.g., powdery detergent or preliminary fabric softener) to be supplied to the tub 40 during a washing cycle. A preliminary additive may be used when the liquid additive supply device 10 is separated from the accommodation part 2 of the detergent dispenser 1.

Since the detergent dispenser 1 extends along the width of the cabinet 30 (e.g., the left-right direction of the cabinet 30 when the washing machine is positioned for operation) at the top of the cabinet 30, the liquid additive supply device 10 and the preliminary additive supply device 20 have relatively large capacities for a liquid additive and a preliminary additive.

Hereinafter, descriptions will be made primarily on the liquid additive supply device 10 that is removably accommodated within the accommodation part 2 of the detergent dispenser 1.

The main body 100 may include two storages parts, for example a first storage part 110 for containing a first additive (e.g., liquid detergent), and a second storage part 120 for containing a second additive (e.g., fabric softener for example). Hereinafter embodiments are described using a liquid detergent storage part 110 and a fabric softener storage part 120 as example, but the present disclosure is not limited to any specific type of additives that can be added in the storages parts 110 and 120.

A nozzle 130 in the main body 100 receives liquid additives from the liquid detergent storage part 110 and the fabric softener storage part 120 and carries the liquid additives upward from the lower portion of the main body 100 to the upper portion thereof.

In this case, the bottom wall of the main body 100 may be downwardly inclined from a front region (where the liquid additives are supplied) toward a rear region where the nozzle 130 is positioned. In this way, the liquid additives can flow under gravity in the main body 100, which prevents the liquid additives from sticking to the lower portion of the main body 100 as would occur if the liquid additives remain static.

A filter 135 having a removable structure may be mounted within the main body 100. The filter 135 can filter dust or other extraneous material mixed in the liquid additives (e.g., which may be introduced inadvertently or for instance by a child), thereby preventing the nozzle 130 from being clogged by the dust or the extraneous material.

Thus, the main body 100 may be partitioned into a first main body portion A and a second main body portion B by the filter 135. More specifically, when viewed from the installation position of the filter 135 (as shown in FIG. 3), the second main body portion B refers to a rear region adjoining the nozzle 130 and the first main body portion A refers to a front region opposite to the nozzle 130.

The liquid detergent storage part 110 and the fabric softener storage part 120 may be partitioned by a partition wall 115. Thus, the liquid detergent stored in the liquid detergent storage part 110 and the fabric softener stored in the fabric softener storage part 120 may be used as a main liquid detergent and a main fabric softener, respectively.

The liquid detergent may be stored in the liquid detergent storage part 110. In this case, a large amount of liquid detergent capable of performing a washing operation multiple times may be stored in the liquid detergent storage part 110.

A liquid detergent residual amount detection buoyancy body 500*a* may be installed in a lower portion of the liquid detergent storage part 110. A liquid detergent residual amount detection magnetic body 510 may be installed within the liquid detergent residual amount detection buoyancy body 500*a* and configured to generate a magnetic field.

The liquid detergent residual amount detection buoyancy body 500*a* may be hingedly coupled to one side of the main body 100 through a connecting arm 520. The liquid detergent residual amount detection buoyancy body 500*a* may swing about a hinge by the buoyancy exerted by the liquid detergent contained in the liquid detergent storage part 110.

A residual amount detection sensor 600 may be installed on the outer surface of the main body 100 in a position facing the liquid detergent residual amount detection buoyancy body 500*a*. In this case, the residual amount detection sensor 600 may be a liquid detergent residual amount detection sensor 600*a* (see FIG. 4). The liquid detergent residual amount detection sensor 600*a* may sense approach of the liquid detergent residual amount detection buoyancy body 500*a*. More specifically, the liquid detergent residual amount detection sensor 600*a* may sense the magnetic field of the liquid detergent residual amount detection magnetic body 510 that is installed within the liquid detergent residual amount detection buoyancy body 500*a*. Thus it can sense the approach of the liquid detergent residual amount detection buoyancy body 500*a* without contacting the liquid detergent residual amount detection buoyancy body 500*a*.

Fabric softener may be stored in the fabric softener storage part 120. A fabric softener residual amount detection buoyancy body 500*b* may be installed in a lower portion of the fabric softener storage part 120. In this regard, a fabric softener residual amount detection magnetic body 510 configured to generate a magnetic field may be installed within the fabric softener residual amount detection buoyancy body 500*b*.

The fabric softener residual amount detection buoyancy body 500*b* may be hingedly coupled to one side of the main body 100 through a connecting arm 520. The fabric softener residual amount detection buoyancy body 500*b* may swing about a hinge by the buoyancy exerted by the fabric softener in the fabric softener storage part 120.

A residual amount detection sensor 600 may be installed on the outer surface of the main body 100 in a position facing the fabric softener residual amount detection buoyancy body 500*b*. In this case, the residual amount detection sensor 600 may be a fabric softener residual amount detection sensor 600*b* (see FIG. 4). The fabric softener residual amount detection sensor 600*b* may sense approach of the fabric softener residual amount detection buoyancy body 500*b*. More specifically, the fabric softener residual amount detection sensor 600*b* may sense the magnetic field of the fabric softener residual amount detection magnetic body that is installed within the fabric softener residual amount detection buoyancy body 500*b*, thereby sensing the approach of the fabric softener residual amount detection buoyancy body 500*b* without directly contacting the fabric softener residual amount detection buoyancy body 500*b*.

Thus, if the liquid detergent storage part 110 and the fabric softener storage part 120 contain sufficient liquid detergent and fabric softener, the liquid detergent residual amount detection buoyancy body 500*a* and the fabric softener residual amount detection buoyancy body 500*b* swing upward and away from the bottom of the main body 100 by a certain distance. Consequently, the intensity of the magnetic field sensed by the residual amount detection sensors 600*a* and 600*b* becomes smaller.

In this configuration, based on the sensing signals transmitted from the residual amount detection sensors 600*a* and 600*b*, it can be determined whether there are sufficient liquid detergent and/or fabric softener in their respective storage parts 110 and 120. Furthermore, a user interface device such as a display device or a buzzer device can be used to notify a user of the respective levels of the liquid additives in the storage parts 110 and 120.

On the other hand, if the residual amount of the liquid detergent and/or the fabric softener in the liquid detergent storage part 110 and the fabric softener storage part 120 are insufficient, the liquid detergent residual amount detection buoyancy body 500*a* and/or the fabric softener residual amount detection buoyancy body 500*b* move toward the liquid detergent residual amount detection sensor 600*a* and the fabric softener residual amount detection sensor 600*b*. As a result, the intensity of the magnetic field sensed by the liquid detergent residual amount detection sensor 600*a* and the fabric softener residual amount detection sensor 600*b* becomes larger.

Thus, based on the sensing signals transmitted from the residual amount detection sensors 600*a* and 600*b*, it can be determined that liquid additives in the liquid detergent storage part 110 and/or the fabric softener storage part 120 are deficient. Furthermore, a control signal can be generated and used to enable the notification device (such as a display device or a buzzer device) to notify a user of the shortage of either or both types of liquid additives.

In general, a larger amount of liquid detergent is used than fabric softener during washing. Thus, the height of the liquid detergent storage part 110 may be configured larger than the height of the fabric softener storage part 120. In other words, the liquid detergent storage part 110 may be larger than the fabric softener storage part 120. However, this discussion is nothing more than one example and may be modified without departing from the scope of the present disclosure.

The nozzle 130 may be installed in each of the liquid detergent storage part 110 and the fabric softener storage part 120. One open end of the nozzle 130 may be disposed adjacent to the bottom surface of the main body 100 (e.g., the second main body portion B). The other end of the nozzle 130 may be coupled to a suction pump (not shown) installed separately. During a washing operation, the liquid additives may be carried upward from the lower portion of the main body 100 through the nozzle 130. Thus, even if the main body 100 is separated from the accommodation part 2 of the detergent dispenser 1, the liquid additives stored in the main body 100 do not flow outward.

A mounting/demounting detection magnetic body 200 may be installed on the bottom surface of the main body 100 (e.g., the first main body portion A) in the front region of the main body 100 where the liquid additives are supplied. In this case, the mounting/demounting detection magnetic body 200 may be installed within a groove portion having a height capable of covering the thickness of the mounting/demounting detection magnetic body 200. Even when the mounting/demounting detection magnetic body 200 is installed on the bottom surface of the main body 100, the main body 100 may be easily accommodated within the accommodation part 2. For example, the mounting/demounting detection magnetic body 200 may be a permanent magnet or an electromagnet.

The mounting/demounting detection sensor 300 may be installed at the accommodation part 2 in a position facing the mounting/demounting detection magnetic body 200. The mounting/demounting detection sensor 300 may sense the magnetic field of the mounting/demounting detection magnetic body 200 and accordingly generate a sensing signal. The sensing signal is transmitted to the control unit 400. In this case, the sensing signal generated by the mounting/demounting detection sensor 300 may be an "on"-signal which indicates that the main body 100 is accommodated within the accommodation part 2. Alternatively, the sensing signal may be an "off"-signal which indicates that the main body 100 is not within the accommodation part 2.

Based on the sensing signals transmitted from the mounting/demounting detection sensor 300, the liquid detergent residual amount detection sensor 600*a* and the fabric softener residual amount detection sensor 600*b*, the control unit 400 can determine the presence (or absence) of the main body 100 in the accommodation part 2 and the sufficiency (or insufficiency) of the liquid detergent and/or the fabric softener stored in the main body 100. Based on such a determination, the notification device 800 may operate to notify a user of the presence of the main body 100 in the accommodation part 2 and the sufficiency of the liquid detergent or the fabric softener left in the main body 100.

More specifically, if the main body 100 is accommodated within the accommodation part 2, the control unit 400 may receive from the mounting/demounting detection sensor 300 an "on"-signal which indicates that the main body 100 is present within the accommodation part 2. If the main body 100 is removed from the accommodation part 2, the control unit 400 may receive from the mounting/demounting detection sensor 300 an "off"-signal which indicates that the main body 100 is not located within the accommodation part 2.

The cover part 700 may selectively cover the upper portion of the main body 100. The cover part 700 may include: a main cover 710 provided with a knob portion having a knob groove 714 and a detergent supply portion for supplying the liquid additives; a liquid detergent supply hole 720 in the detergent supply portion of the main cover 710 and configured to supply the liquid detergent; a fabric softener supply hole 730 in the detergent supply portion of the main cover 710 and configured to supply the fabric softener; and an auxiliary cover 740 coupled to the main cover 710 and configured to open or close the liquid detergent supply hole 720 and the fabric softener supply hole 730.

The fabric softener supply hole 730 is spaced apart from the liquid detergent supply hole 720.

As the liquid detergent storage part 110 and the fabric softener storage part 120 are covered by the cover part 700, dust or the like can be prevented from entering the storage parts 110 and 120. This can also prevent a user from putting extraneous material into the storage parts 110*a* and 120.

Furthermore, a user may easily remove the main body 100 from the accommodation part 2 using the knob groove 714 in the cover part 700. It can prevent the liquid additives from overflowing from the main body 100 when the main body is removed 100 from the accommodation part 2, e.g., by a user.

Hereinafter, the operation and function of the liquid additive supply device 10 according to one embodiment of the present disclosure will be described with reference to FIG. 5.

Figure 5:
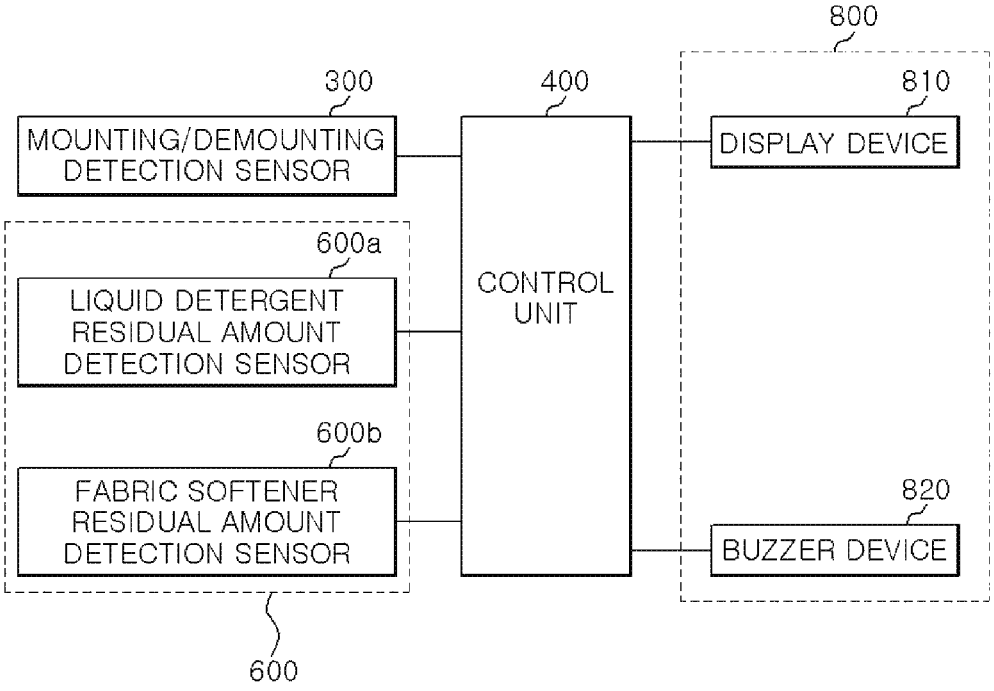
FIG. 5 illustrates an exemplary control mechanism of the liquid additive supply device for a washing machine according to one embodiment of the present disclosure.

FIG. 5 illustrates the configuration of an exemplary liquid additive supply device according to one embodiment of the present disclosure.

Referring to FIG. 5, if a user inserts the main body 100 into the accommodation part 2 of the detergent dispenser 1, the mounting/demounting detection magnetic body 200 and the mounting/demounting detection sensor 300 are in close proximity with each other. Thus, the magnetic field of the mounting/demounting detection magnetic body 200 may be sensed by the mounting/demounting detection sensor 300. At this time, based on the intensity of the magnetic field thus sensed, the mounting/demounting detection sensor 300 may generate a sensing signal (e.g., an "on"-signal) which indicates that the main body 100 is within the accommodation part 2 of the detergent dispenser 1. The mounting/demounting detection sensor 300 may then transmit the sensing signal to the control unit 400.

Accordingly, the control unit 400 may generate a control signal for controlling the notification device 800 such as a display device 810, a buzzer device 820 or the like. Through the notification by the notification device 800, a user may recognize the presence of the main body 100 within the accommodation part 2. At this time, the control unit 400 may control the operation of either or both of the display device 810 or the buzzer device 820.

On the other hand, if the main body 100 has been removed from the accommodation part 2 of the detergent dispenser 1, the mounting/demounting detection sensor 300 cannot sense the magnetic field of the mounting/demounting detection magnetic body 200. Thus, the mounting/demounting detection sensor 300 may generate a sensing signal (e.g., an off-signal) which indicates the absence of the main body 100 in the accommodation part 2. The control unit 400 may then receive the sensing signal and may operate the notification device 800 such as the display device 810 or the buzzer device 820, thereby notifying a user of the fact that the main body 100 does not exist within the accommodation part 2. At this time, the control unit 400 may control the operation of either or both of the display device 810 or the buzzer device 8200.

In this case, the control unit 400 may issue a washing process suspension command to stop a washing process or prevent the start of a washing process. However, this is nothing more than one example. The control unit 400 may issue a command to enable a washing process to be performed using powdery detergent and fabric softener contained in the preliminary additive supply device 20. Accordingly, a user can determine, without having to visually or otherwise directly check, the existence of the main body 100 within the accommodation part 2 of the detergent dispenser 1.

In addition, if the liquid detergent and/or the fabric softener are sufficiently stored in the liquid detergent storage part 110 and the fabric softener storage part 120, the liquid detergent residual amount detection buoyancy body 500*a* and the fabric softener residual amount detection buoyancy body 500*b* swing upward by the buoyancy force of the liquid detergent and the fabric softener and so are lifted away from the lower portion of the main body 100 by a predetermined distance. Thus, the intensity of the magnetic field sensed by the liquid detergent residual amount detection sensor 600*a* and the fabric softener residual amount detection sensor 600*b* becomes smaller.

At this time, based on the sensing signal transmitted from the liquid detergent residual amount detection sensor 600*a* and the fabric softener residual amount detection sensor 600*b*, the control unit 400 may determine that liquid detergent and/or fabric softener are sufficiently stored in the liquid detergent storage part 110 and the fabric softener storage part 120.

On the other hand, if the residual amount of the liquid detergent and/or the fabric softener remaining in their respective storage parts 110 and 120 is insufficient, the liquid detergent residual amount detection buoyancy body 500*a* and/or the fabric softener residual amount detection buoyancy body 500*b* move toward the liquid detergent residual amount detection sensor 600*a* and the fabric softener residual amount detection sensor 600*b*. Consequently, the intensity of the magnetic field sensed by the liquid detergent residual amount detection sensor 600*a* and/or the fabric softener residual amount detection sensor 600*b* becomes larger.

Based on the sensing signals transmitted from the liquid detergent residual amount detection sensor 600*a* and the fabric softener residual amount detection sensor 600*b*, the control unit 400 may determine that the liquid detergent and the fabric softener stored in the liquid detergent storage part 110 and the fabric softener storage part 120 are insufficient. The control unit 400 may notify a user of the shortage of the liquid detergent and the fabric softener through the notification device 800 such as the display device 810 or the buzzer device 820.

According to the embodiment of the present disclosure described above, a user can easily mount a liquid additive supply device to or demount it from an accommodation part in a detergent dispenser.

Reference has been made in detail to the preferred embodiments of the present disclosure, examples of which are illustrated in the accompanying drawings. While the disclosure is described in conjunction with the preferred embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the detailed description of embodiments of the present disclosure, numerous specific details have been set forth in order to provide a thorough understanding of the present disclosure. However, it will be recognized by one of ordinary skill in the art that the present disclosure may be practiced without these specific details. In other instances, well-known methods, procedures, components, and circuits have not been described in detail so as not to unnecessarily obscure aspects of the embodiments of the present disclosure. The drawings showing embodiments of the disclosure are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the disclosure can be operated in any orientation.

Although certain preferred embodiments and methods have been disclosed herein, it will be apparent from the foregoing disclosure to those skilled in the art that variations and modifications of such embodiments and methods may be made without departing from the spirit and scope of the disclosure. It is intended that the disclosure shall be limited only to the extent required by the appended claims and the rules and principles of applicable law.

What is claimed is:

1. A liquid additive supply device for a washing machine, the liquid additive supply device comprising:

a main body coupled to a detergent dispenser of the washing machine and configured to contain a liquid additive;

an accommodation part provided in the detergent dispenser;

a magnetic body coupled to the main body;

a mounting/demounting detection sensor coupled to the accommodation part and configured to detect a proximity of the magnetic body with respect to the mounting/demounting detection sensor and to generate a sensing signal accordingly;

a buoyancy body rotatably and hingedly coupled to a lower portion of the main body through a connecting arm and comprising a liquid additive residual amount detection magnetic body; and a residual amount detection sensor coupled to the accommodation part and configured to sense proximity of the buoyancy body, wherein the main body comprises a nozzle configured to receive the liquid additive and discharge the liquid additive from the main body, wherein the nozzle is disposed at a rear portion of the main body and comprises a first end portion configured to be coupled to a suction pump and a second end portion adjacent to a bottom surface of the main body, the first end portion being disposed at an upper portion of the rear portion of the main body, and wherein the magnetic body is disposed at a front end portion of the bottom surface the main body.

2. The liquid additive supply device of claim 1, wherein the magnetic body is disposed on a lower surface of the main body.

3. The liquid additive supply device of claim 1, wherein the mounting/demounting detection sensor is disposed on an outer surface of the accommodation part.

4. The liquid additive supply device of claim 1, wherein the main body is removably accommodated within the accommodation part.

5. The liquid additive supply device of claim 4 further comprising a control unit configured to receive the sensing signal from the mounting/demounting detection sensor and to determine a presence of the main body within the accommodation part.

6. The liquid additive supply device of claim 5 further comprising a notification device configured to receive a control signal generated by the control unit and to generate an indication of the presence of the main body within the accommodation part.

7. The liquid additive supply device of claim 1, wherein the main body comprises:

a first storage part configured to store a first liquid additive; and a second storage part configured to store a second liquid additive.

8. The liquid additive supply device of claim 7, wherein the nozzle is configured to receive the first and the second liquid additives supplied from the first storage part and the second storage part and to guide the first and the second liquid additives upward from a lower portion of the main body to an upper portion thereof.

9. The liquid additive supply device of claim 8, wherein the first and the second liquid additive are supplied to a front region of the main body.

10. The liquid additive supply device of claim 9, wherein the bottom surface of the main body is downwardly inclined from the front region of the main body toward a rear region of the main body.

11. The liquid additive supply device of claim 1, wherein the residual amount detection sensor is disposed on an outer surface of the accommodation part in a position facing the buoyancy body.

12. The liquid additive supply device of claim 1 further comprising a cover part operable to cover a top opening of the main body.

13. A washing machine comprising:

a detergent dispenser comprising an accommodation part and configured to dispense a liquid additive for washing laundry;

a liquid additive supply device coupled to the detergent dispenser and comprising:

a main body removably coupled to the detergent dispenser and configured to contain a liquid additive;

a magnetic body coupled to the main body;

a mounting/demounting detection sensor coupled to the accommodation part and configured to detect a presence of the main body within the accommodation part by sensing a magnetic field of the magnetic body; and a buoyancy body rotatably and hingedly coupled to a lower portion of the main body through a connecting arm and comprising a liquid additive residual amount detection magnetic body; and a residual amount detection sensor coupled to the accommodation part and configured to sense proximity of the buoyancy body, wherein the main body comprises a nozzle configured to receive the liquid additive and discharge the liquid additive from the main body, wherein the nozzle is disposed at a rear portion of the main body and comprises a first end portion configured to be coupled to a suction pump and a second end portion adjacent to a bottom surface of the main body, the first end portion being disposed at an upper portion of the rear portion of the main body, and wherein the magnetic body is disposed at a front end portion of the bottom surface the main body.

14. The washing machine of claim 13, wherein the liquid additive supply device further comprises a filter configured to partition the main body into a first main body portion and a second main body portion.

15. The washing machine of claim 14, wherein the nozzle is disposed in a bottom portion of the second main body portion and configured to receive the liquid additive from the main body and to transport the liquid additive upward from a lower portion of the main body to an upper portion thereof.

16. The washing machine of claim 14, wherein the magnetic body is disposed on a lower surface of the first main body portion, and wherein the mounting/demounting detection sensor is disposed on an outer surface of the accommodation part in a position facing the magnetic body.

17. The washing machine of claim 15, wherein the bottom surface of the main body is downwardly inclined from a front region of the main body toward a rear region of the main body.

18. The washing machine of claim 13, wherein the buoyancy body comprises a first magnetic body; and wherein the residual amount detection sensor is configured to: sense proximity of the buoyancy body by detecting a magnetic field of the first magnetic body; and generate a signal indicative of an amount of the liquid additive contained in the main body.

19. The washing machine of claim 18, wherein the residual amount detection sensor is disposed on an outer surface of the accommodation part in a position facing the buoyancy body.

20. A washing machine comprising:

a detergent dispenser comprising an accommodation part and configured to dispense a liquid additive for washing laundry;

a liquid additive supply device coupled to the detergent dispenser and comprising:

a main body removably coupled to the detergent dispenser and configured to contain a liquid additive;

a magnetic body coupled to the main body;

a mounting/demounting detection sensor coupled to the accommodation part and configured to detect a presence of the main body within the accommodation part by sensing a magnetic field of the magnetic body; and a buoyancy body rotatably and hingedly coupled to a lower portion of the main body through a connecting arm and comprising a liquid additive residual amount detection magnetic body; and a residual amount detection sensor coupled to the accommodation part and configured to sense proximity of the buoyancy body, wherein the main body comprises a nozzle configured to receive the liquid additive and discharge the liquid additive from the main body, wherein the nozzle is disposed at a rear portion of the main body and comprises an end portion configured to be coupled to a suction pump, the end portion being disposed at an upper portion of the rear portion of the main body, wherein the magnetic body is disposed at a front end portion of a bottom surface the main body, wherein the liquid additive supply device further comprises a filter configured to partition the main body into a first main body portion and a second main body portion, and wherein the nozzle is further disposed in a bottom portion of the second main body portion and configured to receive the liquid additive from the main body and to transport the liquid additive upward from a lower portion of the main body to an upper portion thereof.

* * * * *